United States Patent [19]

Loda et al.

[11] 4,409,511

[45] Oct. 11, 1983

[54] PHASE TRANSITION COOLED WINDOW FOR BROAD BEAM ELECTRON GUN

[75] Inventors: Gary K. Loda, Danville; Sherman R. Farrell, Orinda, both of Calif.

[73] Assignee: RPC Industries, Hayward, Calif.

[21] Appl. No.: 236,808

[22] Filed: Feb. 23, 1981

[51] Int. Cl.[3] ..... H01J 7/28

[52] U.S. Cl. ..... 313/34; 313/35; 313/44; 165/104.32

[58] Field of Search ..... 313/33, 34, 35, 36, 313/420, 44, 363.1; 261/153; 165/DIG. 14, 104.32

[56] References Cited

U.S. PATENT DOCUMENTS

| | | | |
|---|---|---|---|
| 2,856,532 | 10/1958 | Martina | 313/363.1 X |
| 2,898,492 | 8/1959 | Miller | 313/35 |
| 3,105,916 | 10/1963 | Marker et al. | 313/33 |
| 3,306,350 | 2/1967 | Beurtheret | 313/36 X |
| 4,141,224 | 2/1979 | Alger | 313/35 X |

*Primary Examiner*—Alfred E. Smith
*Assistant Examiner*—Sandra L. O'Shea
*Attorney, Agent, or Firm*—Limbach, Limbach & Sutton

[57] ABSTRACT

An apparatus and method for the phase-transition cooling of particle-transparent windows in charged particle accelerator systems, wherein the apparatus and method permit the operation of the particle-transparent window at a desired temperature by directing an atomized, vaporizable coolant liquid over the window surface, the coolant liquid having a boiling point approximately equal to the desired operating temperature of the window, so that heat is absorbed as the liquid coolant changes from a liquid phase to a gaseous phase.

27 Claims, 8 Drawing Figures

PHASE TRANSITION COOLED WINDOW FOR BROAD BEAM ELECTRON GUN

BACKGROUND OF THE INVENTION

This invention relates generally to the cooling of charged-particle-transparent windows used in charged particle accelerator systems and, in particular, to a phase transition cooled window for broad beam electron guns.

The operation of a charged particle accelerator system requires that the particle-emitting cathode be housed in a vacuum-tight housing. Typically, on the wall of the housing opposite the enclosed cathode, there is disposed a particle-attracting anode, which is transparent to such particles while impervious to gas. The vacuum within the housing is thereby maintained while permitting the accelerated particles to be emitted from the accelerator. The particles emitted from the cathode are attracted and accelerated toward the anode, and upon reaching the anode, pass through the particle-transparent anode window to the exterior of the accelerator. In practice, a window which is perfectly transparent to such particles is not realizable. Therefore, the passage of the particles through the window results in some interaction by the particles with the window material. This results in the generation of heat. When particle beam intensities are very high, the heat generated in transparent windows is also very high, leading to possible degeneration of the window material. It is, therefore, desirable to devise some means for cooling these transparent windows.

Desirable characteristics of any cooling means include minimal interference by the cooling apparatus with the particle beam, as well as capacity to remove large quantities of heat.

In the past, attempts at developing such cooling systems have been directed toward the cooling of the periphery of the window, circulation of a gas over the surface of the window, and circulation of a liquid, without phase-over, over the window. In all of the above, the property of thermal conduction is utilized. That is, heat is carried away by electron conduction in metals and by vibration transfer in gases and liquids, without a phase-change in the coolant materials.

When, as above, the periphery of the window is cooled, heat is transferred by electron conduction in the window material. The quantity of heat which may be removed is determined by the heat transfer characteristics of the anode window material. In practice, the above method has proved to be unsatisfactory, often leading to large temperature gradients across the surface of the window and not infrequent disintegration of the anode window material due to excess heat build up.

In a system using gases to take up and carry away heat from the window, the low mass density of the gases satisfies the non-interference requirement above. However, the amount of heat which can be carried away by a gas cooling system is small.

In the liquid based cooling system, heat is transferred to the liquid and carried away. While the heat-carrying capacity of liquids is much higher than that for gases, liquids have higher areal mass densities and, hence, higher degrees of interference with the electron beam. Reference is made to R. C. Marker, et al. U.S. Pat. No. 3,105,916, wherein a liquid based cooling system is described.

SUMMARY OF THE INVENTION

The foregoing and other problems of prior art charged-particle-accelerator window cooling are overcome by the present invention of apparatus and a method for phase transition cooling the window, including atomizing means for atomizing a coolant material having liquid and vapor states, and means for directing the liquid, atomized material into contact with the window to be cooled so that the atomized material absorbs heat from the window and, at least, some of the atomized material changes from a liquid state to a gaseous state. Unlike prior cooling apparatuses, the present invention uses a phase transition system wherein heat is principally consumed locally when the coolant material changes state from a liquid to a gas. The temperature at which this state change occurs corresponds to the boiling point of the material. At such temperature, there is a heat of vaporization which is a function of the amount of liquid cooling material present. The heat of vaporization of the coolant mass is equal to the amount of heat which can be absorbed by the coolant mass during the liquid-to-vapor phase change without a rise in temperature of the material.

Therefore, for a given mass of coolant material having a liquid phase, there will be a corresponding amount of heat which can be absorbed by the material in the liquid-to-vapor change without a change in temperature of the liquid or vapor. By regulating the amount of material present, any amount of heat can be absorbed without a change in temperature of the material, thus providing a stable temperature for the object being cooled. In comparison with the conduction of convection cooling techniques prevalent in past attempts at cooling accelerated particle transparent windows, the phase transition cooling technique provides substantial improvement in heat dissipation capacity for a given quantity of coolant material.

For example, the specific heat of water (the ratio of the amount of heat, in calories, required to raise one gram of water one degree C. In temperature) is 1.0. The heat of vaporization of water is 540 calories per gram. Therefore, while in a conduction cooling system a gram of water can carry away one calorie of heat with a one degree C. rise in temperature, in a phase change system the same gram of water can absorb 540 calories of heat with *no* increase in temperature.

The non-phase change liquid-cooling apparatuses in the prior art are not practicable for use in broad beam particle accelerators. In such systems, a coolant flow chamber is necessary to maintain the coolant material in contact with the window. At low energy levels, for example, 200 KeV to 500 KeV, the effective distance over which an accelerated electron retains most of its energy, when passing through a coolant liquid, is small. The flow chamber depth must, therefore, be kept small, for example, on the order of several hundred micrometers. It is very difficult to maintain a spacing of this order over a large surface area, as is typically present in broad beam electron gun windows. At higher energy levels, larger quantities of liquid coolant are required to dissipate the generated heat, hence the corresponding large areal mass densities of such quantities interfere with and dissipate the electron beam.

In the prior art, if it was desired that a stable operating temperature be maintained, precise control of the liquid flow over the window was required. Any change in beam intensity would result in a change in heat absorption requirements, which in turn would result in a change in temperature of the window. Unless the liquid flow were changed, a change in heat absorbed by the liquid would result in a change in temperature of the liquid.

In the present invention, as long as there is a minimum amount of coolant material present, the temperature will remain the same over a wide range of heat absorption requirements. Coolant material is selected according to the temperature at which the window is desired to be operated. Control requirements over liquid flow rates are significantly reduced.

In addition, the atomization of the coolant material not only enhances the phase change process, it also reduces the areal mass of the coolant material significantly. For example, non-phase-change cooling at an electron beam power density level of 10 watts per second and a coolant velocity of 300 feet per second, results in a coolant-temperature rise of 80 degrees Centigrade and requires a water flow rate of 1.1 $cm^3$/sec. For the same power density level and coolant velocity, phase change cooling requires a water flow rate of only 0.16 $cm^3$/sec. and results in *no* coolant-temperature rise.

When a charged-particle accelerator is operated so that the charged-particles are emitted in periodic bursts which have a duration less than the time between bursts, the charged particle transparent window is heated only during each burst. Another embodiment of the present invention includes means for supplying a vaporizable, coolant liquid, and means for depositing the liquid on the window to form a film of the coolant liquid on the window. During each burst of charged particle emissions, the film absorbs heat from the window and at least some of the film changes from a liquid to a gaseous state.

It is, therefore, an object of this invention to provide a phase transition cooling system for cooling charged-particle-transparent windows in charged particle accelerator systems.

It is a further object of this invention to provide a cooling system wherein an atomized coolant material is directed against the surface to be cooled, and wherein the atomized liquid coolant material changes state from a liquid to a gas.

It is a still further object of this invention to provide a cooling system wherein a sonic nozzle atomizes a coolant material having a liquid state and is disposed so that the atomized material is directed against the surface to be cooled, and so that at least some of the material changes from a liquid to a gaseous state.

It is another object of this invention to provide a phase transition cooled window for broad beam electron guns.

It is another object of this invention to provide a phase transition cooled window for a broad beam electron gun, which is operated in a pulsed mode, wherein the coolant material is deposited on the surface of the window to form a film thereon.

The foregoing and other objects, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1:
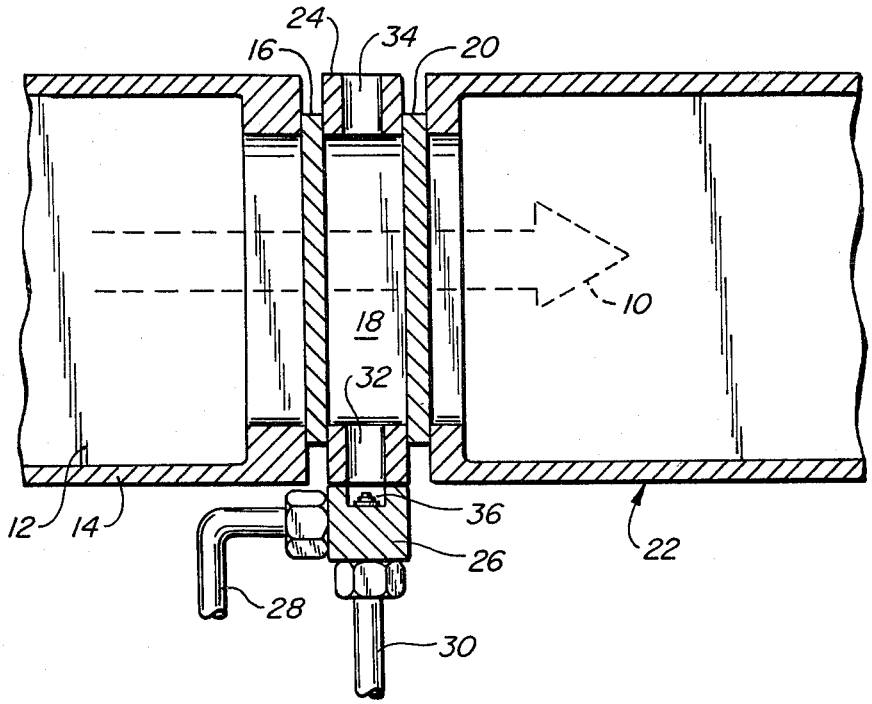
FIG. 1 is a simplified, longitudinal, cross-sectional view of the present invention operatively positioned between a broad beam electron gun and a target.

Referring to FIG. 1, the functional relationship of the phase transition cooled window in a broad beam electron gun is shown. An electron beam, indicated by an arrow 10, is conventionally generated in a vacuum-tight chamber 12 of a broad beam electron gun 14 by means of a cathode assembly, not shown. The beam 10 is electrostatically attracted to an electron-transparent anode window 16, through which it passes, thence into a coolant chamber 18, through a second electron transparent window 20, and then onto a target 22. This target 22 can be an object at normal atmospheric pressure, at several times the normal atmospheric pressure, or at less than normal atmospheric pressure.

The preferred embodiment of the invention includes a housing 24 having the coolant chamber 18, an atomizer 26, a pipe 28 for supplying the liquid to be atomized from an external source (not shown), and propelling means 30, such as a pipe connection to an external source, not shown, of compressed gas, for directing the atomized liquid onto the window 16 to be cooled. A second electron transparent window 20 is provided when the target 22 is at a pressure different from the pressure of the coolant chamber 18 or when isolation between the target and the coolant material is required.

This second window 20 must also be cooled. The second electron transparent window 20 can also be used to form, in conjunction with the housing 24 and the electron transparent anode window 16, the chamber 18 which serves to guide the atomized liquid over the windows 16 and 20. Where lengthy windows are sought to be cooled, the above chamber 18 simplifies the required propelling means 30. In such case, the atomized material is introduced at one end of the chamber 18 at a specific flow rate with the configuration of the chamber 18 directing the flow over the window surfaces to be cooled.

Provided in the coolant chamber housing 24 is an inlet passageway 32 to permit injection of the atomized liquid into the coolant chamber 18, and an exhaust passageway 34, disposed opposite to the inlet passageway 32, to permit an escape of the state-changed coolant material.

While a second electron transparent window 20 is shown in FIG. 1, in applications where no pressure differential is required between the coolant chamber 18 and the target material 22, the second transparent window 20 may not be required. In such case, the coolant chamber housing 24 and/or propelling means 30 should be modified so that the aerosol mixture will be directed uniformly onto the surface of the first electron transparent window 16, without the use of a closed guiding passageway as would be provided by the second transparent window 20.

Transparent windows 16 and 20 are shown in FIG. 1 in exaggerated scale for ease of illustration. In practice, the windows 16 and 20 should be made as thin as possible, consistent with the pressure differentials which exist between the coolant chamber and the electron gun vacuum chamber 12, and the target matter 22. Window material includes a metallic membrane or a plastic film pressure barrier. The choice between metal and plastic is made n the basis of strength, local heat condition, energy deposition and susceptibility of the foil to fatigue and radiation damage.

Figure 2:
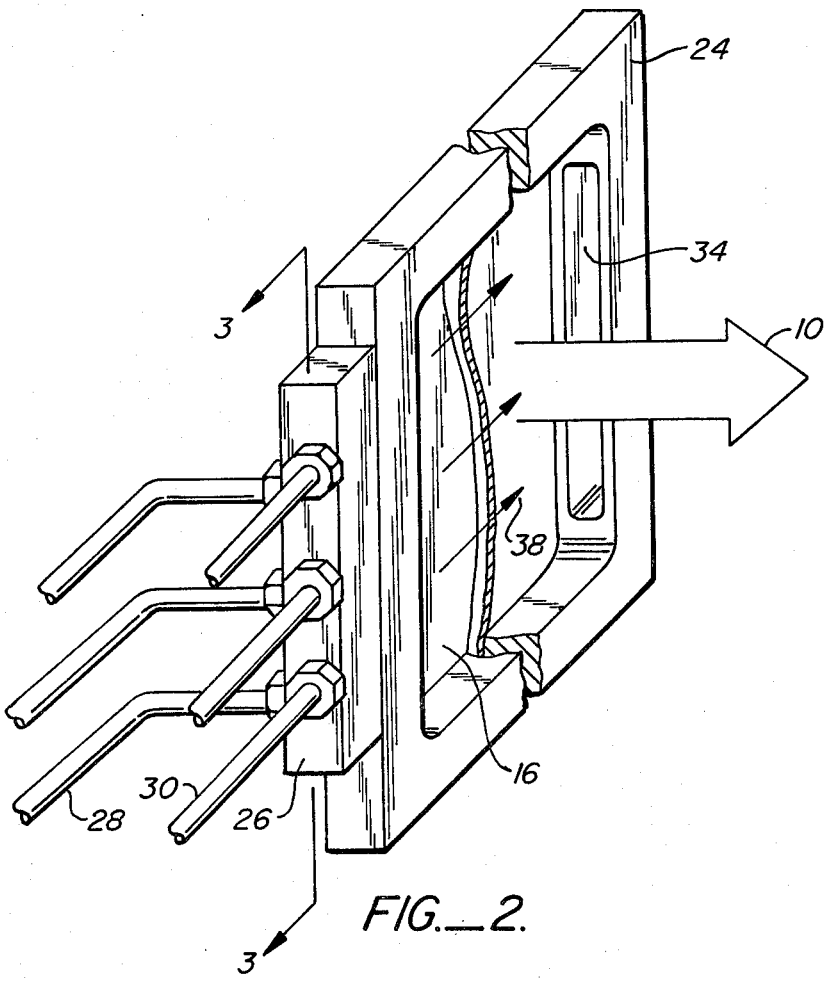
FIG. 2 is a perspective view of the cooling chamber, with the second transparent window not shown, of one embodiment of the present invention.
Figure 3:
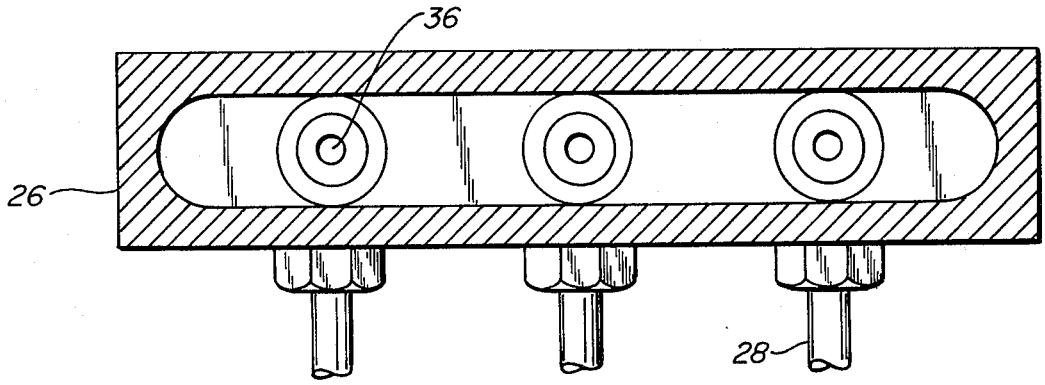
FIG. 3 is a section view of one embodiment of the atomizer means of the present invention taken generally along the lines 3—3 in FIG. 2.

FIG. 2 is a perspective view of the coolant chamber housing 24, with the second transparent window 20 removed. FIG. 3 is a section view of the atomizer section 26 taken generally along the lines 3—3 in FIG. 2. In general, the coolant chamber housing 24 has a chamber shaped to conform to the shape of the electron transparent anode window 16. The window can be round, oblong, rectangular, annular, or any of a variety of shapes. In the preferred embodiment the window is rectangular in shape, approximately 5 cm in width and 50 cm in length. The housing 24 overlays the anode window 16 so as to leave the entire electron transparent portion of the window 16 unobstructed. The atomized liquid inlet passageway 32 and the exhaust passageway 34, which are contained in the coolant chamber housing 24, are aligned in a hypothetical plane substantially parallel to the plane of the electron transparent anode window 16. The atomizer unit 26 is secured to the coolant housing 24 so that atomized liquid emerging from the atomizer structure 26 enters the atomized liquid inlet passageway 32 and thence is directed into the coolant chamber 18. The direction of coolant flow is indicated by arrows 38.

In FIG. 3, pneumatic nozzles 36 for atomizing the coolant material are shown. Coolant material, such as water, is supplied from an external source, not shown, to the nozzles 36 by suitable means, such as conduits 28. A gas flow, such as air, from an external source of compressed air, is supplied to the nozzles 36, by suitable means, such as conduits 30. The nozzles 36 mix the air and water to form a suspension of water droplets in the air flow. The mixture is then emitted from the nozzles 36. The nozzles 36 can be selected to provide a number of different spray patterns to provide the required directivity for the various possible shapes and configurations of the transparent window.

Pneumatic nozzles can be used to atomize the coolant liquid by mixing a gas, which has been accelerated to a high velocity relative to the liquid, with the liquid; the velocity differential thus causing the liquid to be subdivided into fine droplets by the acceleration of the gas through the liquid.

Other atomizing means include sonic nozzles wherein the coolant liquid is caused to flow over a vibrating surface. The frequency of the vibration determines the size of the droplets produced. As described above, the atomized coolant liquid is then mixed with the air to form a suspension of water droplets in the air flow. The mixture is then emitted from the nozzles 36.

Preferably, the droplet size produced by the atomizing means 26 should be small with respect to the accelerated electron range. The electron range is determined by the magnitude of the electrostatic potential used to accelerate the electrons and the areal mass density of the material through which they must pass. The greater the areal mass density, or the lower the accelerating potential, the lower the electron range. With a 200 KeV accelerating potential, for example, the electron range in water is on the order of a few hundred micrometers, hence a atomized water droplet size of 30 to 50 micrometers is preferred.

The pneumatic nozzles disclosed in FIG. 3 can be substituted for by sonic nozzles (hereinafter also designated as 36). When the coolant liquid is atomized by, for example, sonic nozzles 36, air flow containing the atomized coolant liquid is directed onto the anode window 16 in a hypothetical plane parallel to the anode window 16. As the atomized liquid comes into contact with the hot surface of the anode window 16, it absorbs sufficient heat from the anode window 16 to vaporize.

The amount of atomized coolant which changes state, hence the amount of heat consummed in the state-change operation, is determined by the atomized liquid content of the air flow, the rate of flow of the atomized liquid across the window to be cooled, and the heat content of the window to be cooled. For example, stable temperature operation can be obtained when the anode window is run at a power density corresponding to 155 watts per square centimeter when 37% of the atomized liquid flowing across the anode window changes state. Typical improvements in efficiency due to the use of phase change cooling include, for example, an 80 fold improvement in cooling capacity from 1.5 watts per square centimeter, when only air is used as a cooling material, to 123 watts per centimeter, when atomized water is used as the cooling material.

The particular coolant material used is chosen according to the temperature at which the anode window is sought to be operated and the power density of the electron beam used. For example, an operating temperature of approximately 100 degrees centigrade can be maintained, at atmospheric pressure, at an operating power density of 77 watts per square centimeter when water is used as a coolant material. On the other hand, an operating temperature of approximately 200 degrees centigrade can be maintained, at atmospheric pressure, at a power density level of 50 watts per square centimeter when ethylene glycol is used as the coolant material. At different operating pressures the operating temperature will correspond to the temperature of vaporization of the particular material at the particular pressure.

Because various materials have different heats of vaporization, the amount of coolant material which must come into contact with the anode window differs from material to material. For example, since ethylene glycol has a heat of vaporization almost one-third that of water, more ethylene glycol is necessary to cool a particular operating power density than when water is used as the coolant material.

Figure 4:
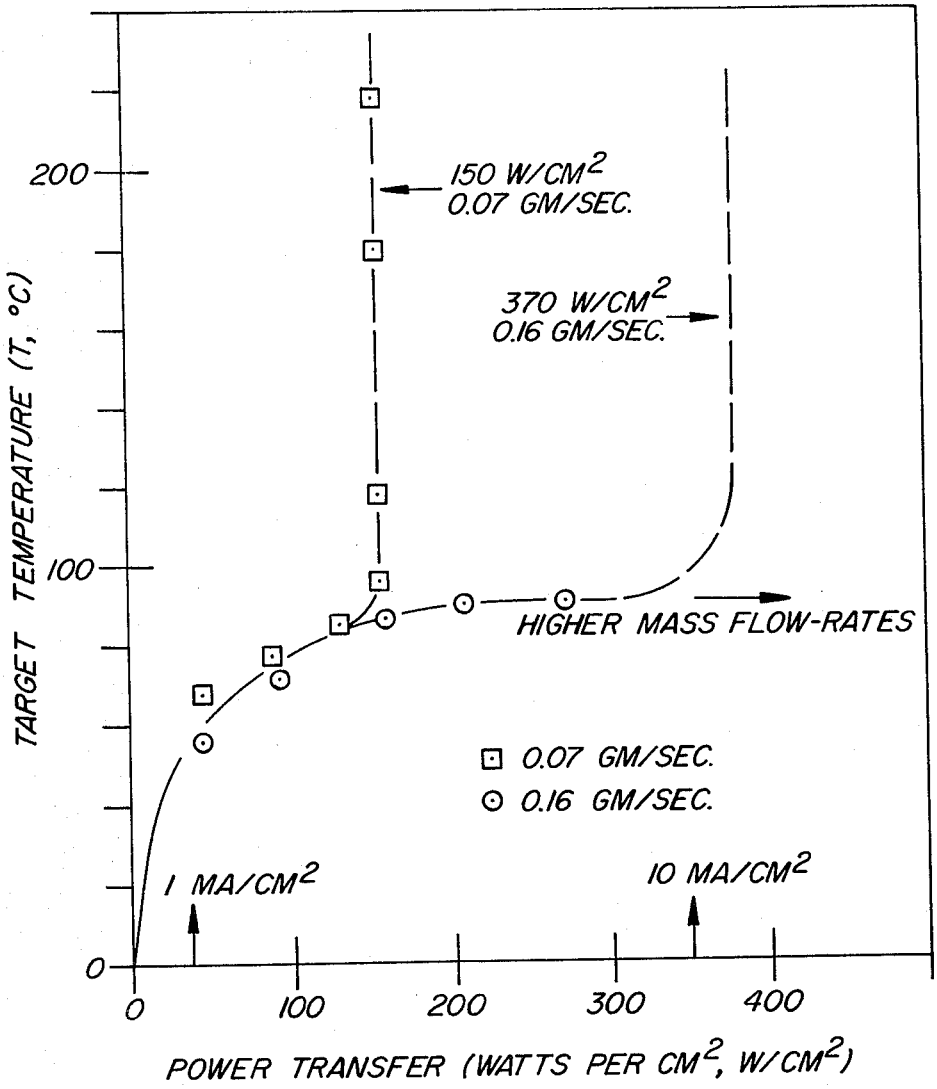
FIG. 4 is a graph of typical heat absorption characteristics of the phase-transition cooling system for various coolant mass flow rates.

FIG. 4 illustrates the increase in heat absorbing capacity of the atomized coolant liquid when different mass flow rates are used. Of course, the higher the mass flow rates the greater the degree of interference of the coolant material with the electron beam.

On the other hand, stable, high temperature operation of the window, for example at 200 degrees centigrade, which is not realizable when water is used as a coolant under normal conditions, can be obtained through the use of ethylene glycol (boiling point of approximately 200 degrees C.) as the coolant material. Similarly, stable, low temperature operation can be realized using materials having low temperature boiling points. Again, the heat dissipation capacity of a particular material at its boiling point is a function of its heat of vaporization.

In the preferred embodiment the exhaust passageway 34 is unrestricted. The structure of the coolant chamber 18, and the exhaust passageway 34 can be modified to accommodate the various operating conditions of the electron gun 14 and the target 22. For example, when the target 22 is at a higher pressure than that of the coolant chamber 18, the exhaust passageway 34 can be modified to restrict the flow of coolant material being exhausted. This, in turn, increases the pressure within the coolant chamber 18, thereby countering the pressure applied to the second transparent window 20 by the higher pressure target atmosphere 22. Additionally, by increasing the pressure within the chamber 18 the temperature of vaporization, hence the operating temperature of the window can be controlled.

When an unrestricted exhaust passageway 34 is required, various supporting rods or ribs can be added to strengthen the transparent windows 16 and 20, without significantly impeding the electron beam 10.

Figure 5:
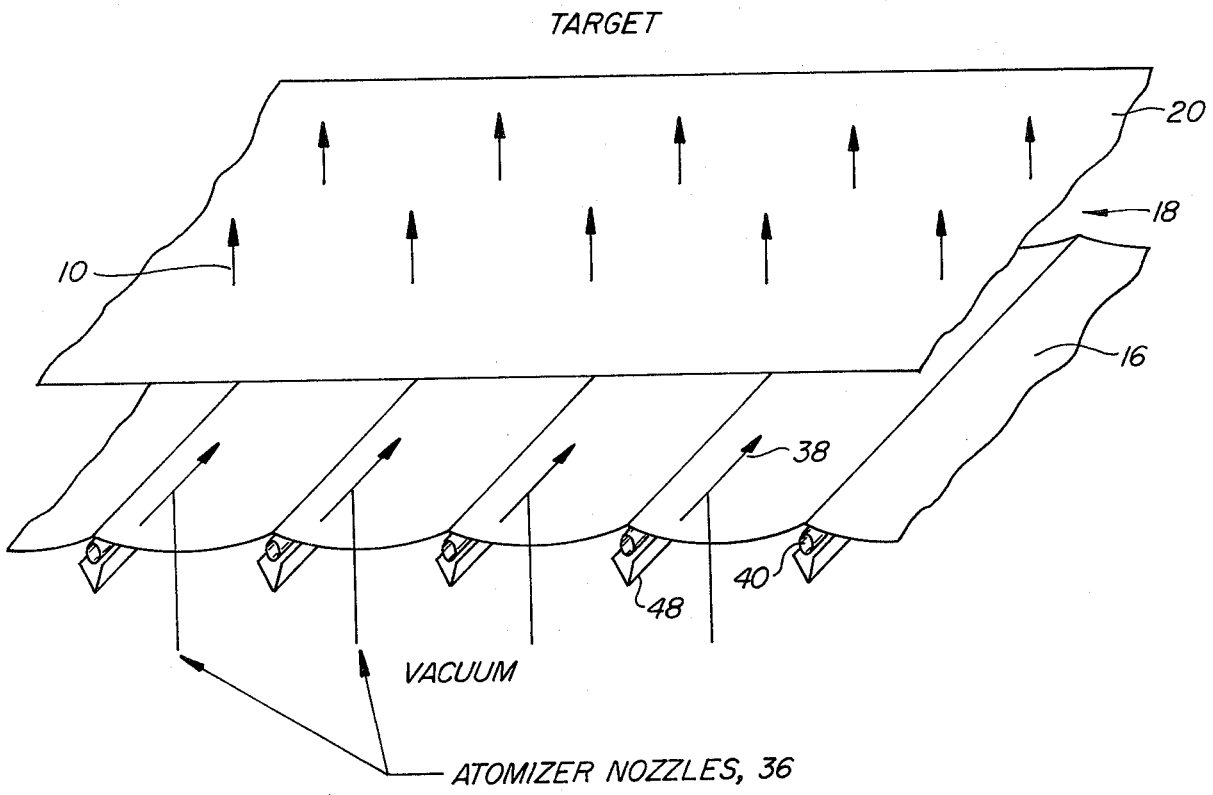
FIG. 5 is a simplified illustration of one window configuration of the present invention.

FIG. 5 illustrates the use of supporting rods 40 on the vacuum-side of the anode window 16. The higher pressure of the coolant chamber 18 presses in against the anode window 16, but is countered by the supporting rods 40. In this manner, thinner windows can be used while maintaining the required electron gun vacuum, with negligible interference with the electron beam itself. When rods 40 are used in this manner, electron beam shields 48 are disposed between the rods 40 and the electron beam 10 to deflect the beam away from the rods. The shields are typically not one hundred percent effective; therefore, conventional liquid cooling of the rods 40 (circulation of liquid through the interior of the rods) is used.

The second transparent window 20 is shown unsupported in FIG. 5. When pressure differentials between the target 22 and the coolant chamber 18 are greater than 2 or 3 atmospheres, or when a thinner second window is desired, supporting ribs for the second transparent window can be used.

Figure 6:
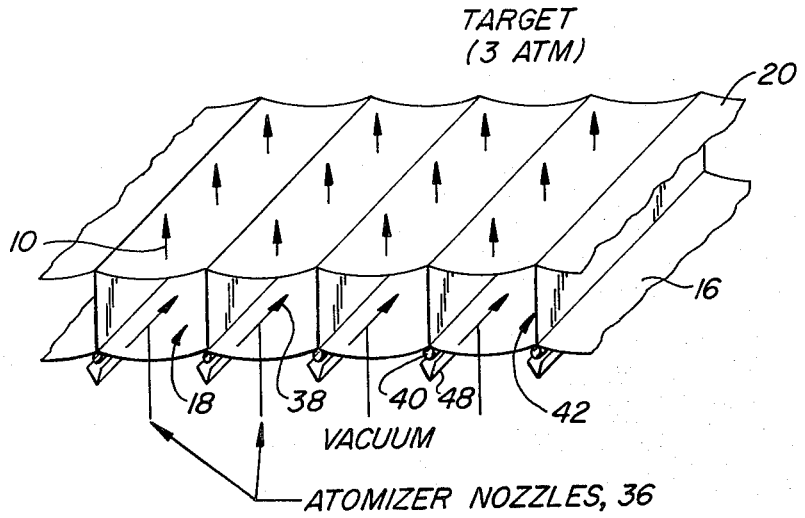
FIG. 6 is a simplified illustration of an alternative window configuration of the present invention for medium pressure coolant chamber application.

FIG. 6 illustrates the use of planar ribs or webs 42 disposed in a hypothetical plane perpendicular to the transparent windows 16 and 20 and parallel to the direction of flow of the cooling medium which provide support to the second transparent window 20 when there is medium pressure (1–3 atmospheres) in the coolant chamber 18 and 3 atmospheres of pressure at the target 22.

Figure 7:
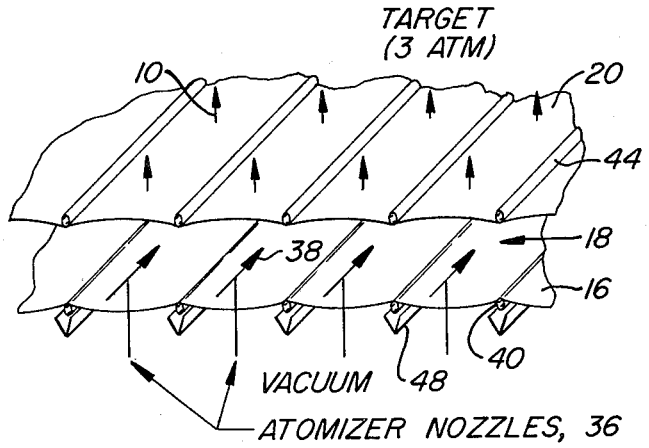
FIG. 7 is a simplified illustration of another alternative window configuration of the present invention for use with high pressure flow in the coolant chamber.

When the pressure within the coolant chamber 18 exceeds the pressure of the target chamber 22, the configuration shown in FIG. 7 having supporting rods 44 on the side of the second transparent window 20 opposite that of the electron gun 14 can be used.

Figure 8:
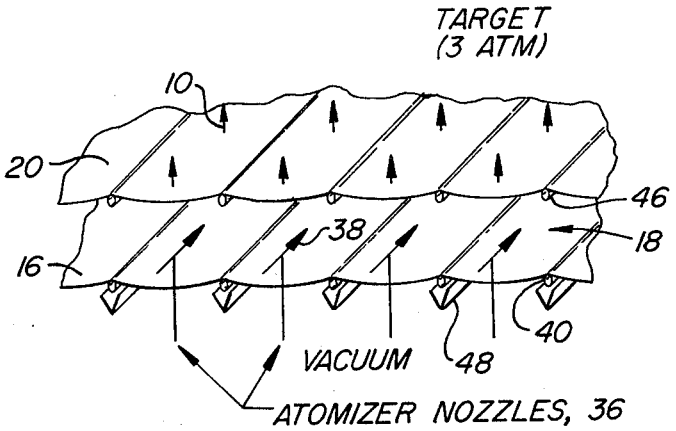
FIG. 8 is a simplified illustration of still another alternative window configuration of the present invention for use with medium pressure flows in the coolant chamber.

FIG. 8 shows the use of rod shaped ribs 46 on the side of the second transparent window 20 which is closest to the electron gun 14 when the pressure in the coolant chamber 18 is less than the target chamber 22 to support the second transparent window 20.

For a more specific description of the construction of these various coolant chamber 18 structures and other potential structures, reference is made to the R. C. Marker, et al. U.S. Pat. No. 3,105,916, and is to that extent herein incorporated.

The various structures described above for use under different coolant chamber 18, and target 22 conditions, are intended only as examples of the numerous other possible configurations which can be implemented.

The method of phase transition cooling of particle transparent windows in particle accelerators, comprises the steps of atomizing a coolant material having a liquid state, and then directing the atomized material onto the window to be cooled so that the atomized material absorbs heat from the window and, at least, some of the material changes from a liquid to a gaseous state.

When a charged-particle accelerator is operated in a pulsed mode, charged particles are emitted from the charged particle transparent window in periodic bursts. Typically, these bursts are short in duration with respect to the time period between bursts. Under these conditions, the window becomes heated only during each charged particle burst. It has been discovered that when a film of liquid coolant is deposited onto the surface of the window to be cooled, such film is capable of dissipating a significant amount of heat when the liquid collant undergoes a phase change from a liquid to a gaseous state.

As discussed above, the amount of heat generated within the window material depends upon the particle beam intensity, or energy level. When the charged-particle accelerator is used in a pulsed mode, the heat generated is also a function of the duration of the charged particle bursts. Therefore, for a given beam energy level and a given burst duration, a corresponding quantity of heat will be generated in the charged particle transparent window.

The amounts of heat which can be dissipated by the film of coolant liquid which is deposited on the charged particle transparent window surface is a function of the amount of liquid present. If the thickness of the film is large, for example, greater than several hundred micrometers, the problems of limited electron range present when a non-atomized mass of liquid coolant is used, will arise. On the other hand, for very thin films of liquid coolant, the corresponding heat capacity of such film is small. However, the problem of excessive interference with electron beam is eliminated.

Where the duration of the charged-particle bursts is kept small, there will be sufficient heat capacity in the film which is present to absorb all of the heat generated in the window material by each burst of charged particles. Between each burst, a film of liquid coolant is deposited onto the surface of the window. During each burst, the heat generated in the window is absorbed by the film, and at least some of the liquid coolant is caused to change from a liquid to a gaseous state.

For example, the beam energy levels of 200 KeV to 500 KeV, burst durations of less than two microseconds, and time periods of approximately 10 milliseconds between each burst, a film of coolant liquid having a thickness of the order of a few tens of micrometers will be sufficient to dissipate all of the heat generated in the window by each burst.

For operation under the above described conditions, the present invention has an embodiment similar to that of the window cooling apparatus just described for the continuous mode operation of a charged-particle accelerator system. However, the coolant liquid supply means need not supply coolant liquid to the atomizer section 26 on a continuous basis. The supply means should, instead, be regulated so that atomized material is injected into the coolant chamber 18 during the time period when no electron emission is occurring. The regulated supply means can take the form of pump which is operated in synchronization with the pulsing of the charged-particle accelerator system.

In the event that the energy generated in the transparent window 16 (and 20, if a second window is used) is greater than the heat capacity of the deposited film of liquid coolant, a flow of atomized coolant through the coolant chamber 18 will be required to dissipate the excess heat. In such case, the operation of the charged particle transparent window coolant apparatus will be identical to that when the accelerator 14 is operated in a continuous mode.

The method of phase transition cooling of particle transparent windows in particle accelerators when the particle accelerators are operated in a pulsed mode, and wherein the window is heated during the duration of each pulse of charged particles, comprises the steps of supplying a vaporizable, liquid cooling material; and depositing the cooling material on the surface of the window to be cooled to form a film of the liquid coolant, so that during the time period when charged particles are being emitted through the window, the film absorbs heat from the window and at least some of the coolant material changes from a liquid to a gaseous state.

The terms and expressions which have been employed here are used as terms of description, and not of limitation, and there is no intention in the use of such terms and expressions of excluding equivalence of the features shown and described, or portions thereof, it being recognized that various modifications are possible within the scope of the invention claimed.

What is claimed is:

1. Apparatus for cooling a charged-particle-transparent window of the type used in combination with a charged particle accelerator system, the cooling apparatus comprising:

means for supplying a vaporizable, liquid coolant material;

means for atomizing the liquid coolant material and for directing the atomized material onto the window whereby when the window is heated by the charged particles, the atomized material absorbs heat from the window as at least some of the material changes from a liquid to a gaseous state.

2. The apparatus of claim 1, wherein the atomizing and directing means comprise, means for generating a gas stream and for mixing it with the coolant material to atomize it and to hold it in suspension in the gas stream.

3. The apparatus of claim 2 wherein the window comprises first and second, parallel plane particle-transparent windows, and wherein the atomizing and directing means further comprise:

a housing, sandwiched between the first and the second windows, and including a chamber, an inlet passageway for introducing the suspended atomized coolant material into the chamber, and an exhaust passageway for exhausting the state-changed coolant material from the chamber, the chamber being open to the first window and the second window so that the suspended atomized material, introduced through the inlet passageway, is directed into the chamber and into substantially uniform contact with both of the windows.

4. The apparatus of claim 1, wherein the liquid coolant supply means supplies the liquid at a non-zero velocity, and wherein the means for atomizing and directing the liquid coolant material are a plurality of pneumatic nozzles which comprise:

means for generating a gas stream having a velocity greater than the liquid coolant velocity;

means for mixing the gas stream with the coolant material so that the gas stream is accelerated through the liquid coolant to subdivide the liquid coolant into droplets.

5. The apparatus of claim 1, wherein the atomizing and directing means comprise:

sonic nozzle means for atomizing the liquid coolant into droplets, and means for propelling the atomized droplets toward the window.

6. In charged particle accelerator systems having at least one charged-particle-transparent window which becomes heated during operation of the system, an apparatus for cooling the window comprising, sonic nozzle means for atomizing a coolant material having liquid and vapor states and for propelling the atomized droplets toward the window, wherein the nozzle means are positioned with respect to the window so that the atomized material is directed onto the window and absorbs heat and whereby at least some of the coolant material changes from a liquid to a gaseous state upon contacting the heated window.

7. The apparatus of claim 3 wherein the exhaust passageway further includes means for regulating the exhaust flow of the phase-changed coolant material.

8. In a broad beam electron gun having an electron transparent anode, an apparatus for cooling the anode comprising, means for supplying a vaporizable, liquid coolant;

sonic nozzle means for atomizing the vaporizable, liquid coolant;

gas stream means for directing the atomized material in a continuous flow against the transparent anode; and at least one passageway for confining the atomized material to an area immediately adjacent to the transparent window, so that the atomized material absorbs heat from the transparent window and at least some of the material changes from a liquid to a gaseous state.

9. Apparatus for cooling a heated, charged-particle transparent, first window of the type used in a particle accelerator system, the window cooling apparatus comprising:

means for supplying a vaporizable, liquid coolant;

means for atomizing the coolant and for directing the atomized coolant onto the window so that the atomized coolant absorbs heat from the window and at least some of the coolant changes from a liquid to a gaseous state.

10. The apparatus of claim 9, wherein the atomizing and directing means comprise, means for generating a gas stream and for mixing it with the coolant material to atomize it and to hold it in suspension in the gas stream.

11. The apparatus of claim 10 further comprising:

a second particle-transparent window which is parallel to the first window;

an annular housing which is closed at one end by the first window, and is closed on the other end by the second window to define a cooling chamber, and further including an inlet passageway for introducing the atomized coolant into the cooling chamber and an exhaust passageway for exhausting the state-changed coolant from the cooling chamber, the cooling chamber being open to the first window and to the second window so that the atomized material, introduced through the inlet passageway, is directed into the chamber and into substantially uniform contact with both of the windows.

12. The apparatus of claim 1, 4, or 9 wherein the coolant material is water.

13. The apparatus of claims 1, 4, 6 or 9 wherein the coolant material is ethylene glycol.

14. The apparatus of claims 2, or 10 wherein the gas stream is air.

15. In charged particle accelerator systems having at least one charged-particle-transparent window which becomes heated during operation of the system, a method for cooling the heated window comprising the steps of, atomizing a vaporizable, liquid coolant material; and directing the atomized coolant material onto the transparent window so that the atomized coolant material absorbs heat from the window and at least some of the coolant material changes from a liquid to a gaseous state.

16. The method of claim 15 wherein the directing step further comprises the steps of entraining the atomized coolant material in a gas stream and directing that gas stream against the window.

17. Apparatus for cooling a charged-particle transparent first window of the type used in a particle accelerator system, wherein charged particles are periodically emitted through the first window, in bursts having a time period which is less than the elapsed time between the emissions, and further wherein the first window is heated as a result of the emissions, the cooling apparatus comprising:

means for supplying a vaporizable, liquid coolant; and means for depositing a film of the liquid coolant onto the first window so that the film of liquid coolant absorbs heat from the window and at least some of the coolant changes from a liquid to a gaseous state.

18. The apparatus of claim 17 further including control means for regulating the liquid coolant film depositing means so that the film depositing means is operational only between the charged particle emission periods.

19. The apparatus of claim 17 wherein the vaporizable liquid cooling material is water.

20. The apparatus of claim 17 wherein the vaporizable liquid cooling material is ethylene glycol.

21. The apparatus of claim 17 wherein the liquid coolant film depositing means comprises:

atomizer means for atomizing the liquid coolant; and gas stream means for directing the atomized coolant onto the first window to deposit a film of the liquid onto the first window.

22. The apparatus of claim 21 further comprising:

a second charged-particle-transparent window which is parallel to the first window;

an annular housing which is closed at one end by the first window, and is closed at the other end by the second window to define a cooling chamber, and further including an inlet passageway for introducing the atomized liquid coolant into the cooling chamber and an exhaust passageway for exhausting the state-changed coolant from the cooling chamber, the coolant chamber being open to the first window and to the second window so that the atomized material, introduced through the inlet passageway, is directed into the chamber and into substantially uniform contact with both of the windows so that a film of the coolant liquid is deposited on both windows.

23. In charged particle accelerator systems having a charged particle transparent window and wherein charged particles are periodically emitted through the window, in bursts having a time period which is less than the elapsed time between emissions, and further wherein the window is heated as a result of the emissions, a method for cooling the heated window comprising the steps of:

atomizing a vaporizable, liquid coolant material; and depositing the atomized coolant material onto the transparent window to form a film of the liquid on the window so that during the time period when charged particles are being emitted at least some of the coolant material changes from a liquid to a gaseous state.

24. The apparatus of claim 1 wherein the atomizing and directing means comprise means for generating a gas stream and for mixing it with the coolant material to form an aerosol from the coolant material and the gas stream.

25. The apparatus of claim 1 wherein the atomizing and directing means atomize the coolant material into droplets each of which has a diameter which ranges from between 30 and 50 micrometers.

26. The apparatus of claim 2 wherein the generating and mixing means atomize the coolant material and mix a predetermined amount of the atomized coolant material with the gas stream to provide a specified flow rate of the coolant material so that the heat absorbed by the atomized coolant material from the window is principally consumed locally when the atomized coolant material changes state from a liquid to a gas.

27. The apparatus of claim 26 wherein the predetermined amount of atomized coolant has a heat of vaporization and further wherein the predetermined amount of atomized coolant is selected so that its corresponding heat of vaporization is substantially equal to the amount of heat which is sought to be absorbed and so that the atomized coolant material absorbs heat by way of a state change from a liquid to a gas without a substantial rise in the temperature of the atomized coolant material.

* * * * *